US012736239B2

(12) United States Patent
Corona

(10) Patent No.: US 12,736,239 B2
(45) Date of Patent: Sep. 15, 2026

(54) UV DISINFECTANT LIGHT SYSTEM

(71) Applicant: DSM&T Company Inc., Fontana, CA (US)

(72) Inventor: Sergio Corona, Fontana, CA (US)

(73) Assignee: DSM&T COMPANY INC., Fontana, CA (US)

( * ) Notice: Subject to any disclaimer, the term of this patent is extended or adjusted under 35 U.S.C. 154(b) by 1212 days.

(21) Appl. No.: 17/353,272

(22) Filed: Jun. 21, 2021

(65) Prior Publication Data

US 2022/0404043 A1 Dec. 22, 2022

(51) Int. Cl.

| | |
|---|---|
| ***F24F 8/22*** | (2021.01) |
| ***F24F 11/38*** | (2018.01) |
| ***F24F 11/56*** | (2018.01) |
| ***F24F 11/88*** | (2018.01) |
| ***F24F 13/02*** | (2006.01) |

(52) U.S. Cl.

CPC ..... *F24F 8/22* (2021.01); *F24F 11/38* (2018.01); *F24F 11/56* (2018.01); *F24F 11/88* (2018.01); *F24F 13/02* (2013.01)

(58) Field of Classification Search

CPC . A61L 2/0047; A61L 2/02; A61L 2/08; A61L 2/10; A61L 9/00; A61L 9/18; A61L 9/20; A61L 9/22; F24F 8/22; F24F 11/38; F24F 11/56; F24F 11/88; F24F 13/02; G05D 23/00; H01R 13/00

See application file for complete search history.

(56) References Cited

U.S. PATENT DOCUMENTS

| | | | | |
|---|---|---|---|---|
| 5,422,487 | A * | 6/1995 | Sauska | C02F 1/325 250/436 |
| 6,190,191 | B1 | 2/2001 | Pasternak | |
| 6,589,486 | B1 * | 7/2003 | Spanton | F24F 11/30 422/120 |
| 6,746,134 | B1 | 6/2004 | Guzorek | |
| 7,107,778 | B1 | 9/2006 | Witham et al. | |
| 7,332,124 | B2 | 2/2008 | Trifu et al. | |

(Continued)

FOREIGN PATENT DOCUMENTS

| | | | |
|---|---|---|---|
| DE | 202008001362 | U1 | 4/2008 |
| KR | 101328260 | B1 | 11/2013 |
| KR | 101569395 | B1 | 11/2015 |

OTHER PUBLICATIONS

Abajo et al.; "Back to Normal: An Old Physics Route to Reduce SARS-CoV-2 Transmission in Indoor Spaces", ACS Nano 2020, 14, 7, 770✓ 7713.

(Continued)

*Primary Examiner* — Maris R Kessel
*Assistant Examiner* — Nebyate Seged
(74) *Attorney, Agent, or Firm* — Ruggiero McAllister & McMahon LLC

(57) ABSTRACT

A UV light disinfectant system is provided that addresses the problems associated with catastrophic failure of the device due to the presence of moisture or corrosive elements getting into the light fixture and damaging internal power connections of the device. Additionally, the UV light disinfectant system is provided with safety features that prevent unintentional exposure of maintenance personnel to the intense UV light used to disinfect air passing through the duct on which the device is mounted.

18 Claims, 12 Drawing Sheets

(56) References Cited

U.S. PATENT DOCUMENTS

| | | | | |
|---|---|---|---|---|
| 2005/0069465 | A1* | 3/2005 | McEllen | A61L 9/015 422/4 |
| 2006/0186782 | A1* | 8/2006 | Ciancanelli | C02F 1/325 313/318.01 |
| 2016/0370813 | A1* | 12/2016 | Hoglund | G05D 23/1902 |
| 2020/0009286 | A1* | 1/2020 | Zarcone | H05B 47/19 |
| 2021/0057846 | A1* | 2/2021 | Lai | H01R 13/62 |

OTHER PUBLICATIONS

Martin Z. Bazant and John W. M. Bush, "A guideline to limit indoor airborne transmission of COVID-1", Proceedings of the National Academy of Sciences of the United States of America, PNAS Apr. 27, 2021 118 (17).

LightTech LightSources; "UVC Germicidal Lamps"; website: https://www.light-sources.com/solutions/germicidal-uvc-lamps/; downloaded Jun. 18, 2021.

Field Controls, "UV Aire Air Purifying System" Instruction Manual; Aug. 2009.

Canadian Examination Report dated Nov. 1, 2023 from corresponding Canadian Patent Application No. 3,161,181, 4 pages.

* cited by examiner

UV DISINFECTANT LIGHT SYSTEM

FIELD OF THE INVENTION

The invention relates to an Ultraviolet (UV) light disinfecting system that is designed to be installed in ductwork of a Heating Ventilation Air Conditioning (HVAC) system, and more particularly, to a sealed device that prevents moisture and or other elements from entering the housing of the UV light system from the ductwork.

BACKGROUND OF THE INVENTION

With the advent of a global pandemic and the concern over airborne viruses or bacteria, many companies are investigating decontamination systems. In particular, the airborne transmissibility of SARS-CoV-2 (Covid) has raised concerns over indoor air quality. Scientists and doctors are submitting that there "is now overwhelming evidence that indoor airborne transmission associated with relatively small, micron-scale aerosol droplets plays a dominant role in the spread of COVID-19, especially for so-called "super-spreading events", which invariably occur indoors." Article entitled "*A guideline to limit indoor airborne transmission of COVID*-19" by Martin Z. Bazant and John W. M. Bush published in *Proceedings of the National Academy of Sciences of the United States of America*, PNAS Apr. 27, 2021 118 (17) e2018995118; https://doi.org/10.1073/pnas.2018995118.

In view of relatively high indoor transmission rates for Covid, there is a need to ensure that recirculated air is free of harmful particulates. One system that has been used for decontamination purposes is Ultraviolet (UV) light, which has been proven to kill many forms of bacteria and viruses. In fact, the article entitled, *Back to Normal: An Old Physics Route to Reduce SARS-CoV-2 Transmission in Indoor Spaces* recommended the "use of UV-C light as a . . . way to limit virus spread in the current SARS-CoV-2 pandemic." *ACS Nano* 2020, 14, 7, 7704-7713 https://pubs.acs.org/doi/abs/10.1021/acsnano.0c04596. This is especially true for air that recirculates in a building such as in office space.

Various UV disinfection systems have been utilized with various levels of effectiveness over the years. One ductwork mounted air disinfection system is disclosed in U.S. Pat. No. 6,746,134 (the '134 patent) that is directed to "kill contaminates known to exist within heating, ventilation, and air conditioning (HVAC) systems." Col, 1, II. 15-17. The system disclosed in the '134 patent includes a UV lamp that is mounted to a base piece that can be inserted into a lateral side of ductwork to expose the air in the ductwork to the UV light emitted from the UV lamp. This system exposes the air moving through the ductwork to the UV light to kill bacteria and virus that may be present in the recirculated air.

One problem with the '134 patent is that the power connections for the system are not sealed from the air in the ductwork. For example, the '134 patent describes that a protrusion 50 on the base will interact with a switch in the power unit. However, there is no seal between the air duct and the switch. This will unfortunately expose the switch and electrical components to corrosion and moisture that will cause the internal electronics to prematurely fail. For example, with respect to FIG. 4 the internal components of the fixture are completely exposed and open to the ductwork via channel 80.

Another problem with the '134 patent is that it utilizes a spring switch to selectively switch the power to the UV lamp. For example, when the power unit 10 is rotated, the protrusion 50 that interacts with switch 52 moves away from switch 52 allowing the power to be cut off from the UV lamp. However, moisture from the air in the ductwork will severely corrode the spring switch causing a failure of the switch to turn off. This would result in person removing the UV lamp being directly exposed to the intense UV light, which is very dangerous.

Still another problem with the '134 patent is that there is a window that is provided in the base that provides a visual indication to someone looking through the window as to whether the UV lamp is currently functioning. However, UV light is very dangerous, especially at the intensity levels needed to kill viruses such as Covid. Additionally, there is no means of knowing whether the UV lamp is functioning short of physically entering the space and visually confirming that the UV is exiting a window provided in the base portion of the light.

Accordingly, it would be advantageous to provide a UV light disinfectant system that could be removably mounted in a ductwork that would address the problems described above.

SUMMARY OF THE INVENTION

What is desired is a system and method for disinfecting air moving through a ductwork with UV light where the electronics for the UV light are protected from the adverse elements of the ductwork.

It is further desired to provide a system and method for disinfecting air moving through a ductwork that provides enhanced safety by preventing a user from being contacted by the intense UV light when inspecting the system or changing the UV lamp.

It is still further desired to provide a system and method for disinfecting air moving through a ductwork that is reliable and is not subject to failure due to common wear of mechanical pieces.

It is yet further desired to provide a system and method for disinfecting air moving through a ductwork that can provide an indication to a user in a safe manner that the UV lamp has failed or should be replaced.

In one configuration, a system is provided that includes a base that is connectable to an exterior surface of ductwork. The base portion includes a central opening that is designed to fit over an opening formed in the ductwork. The base further includes a power connector that is coupled to AC power for providing electrical power to the UV lamp. The power connector is provided as a raised power socket affixed to the base that is designed to mate with a configuration of pins.

The system further includes a removeable body that includes a UV lamp socket adapted to receive the UV lamp. The removeable body includes a power socket cavity that is designed to engage with and receive the raised power socket on the base. The power socket cavity is provided with several pins that are designed to engage with corresponding openings positioned in the raised electrical socket. In one configuration the power socket cavity is provided with at least one undercut that interacts with a corresponding undercut on the raised power socket such that when the raised power socket is fully inserted into the power socket cavity the undercuts interact to lock the removeable body and base together. In another configuration the raised power socket is provided with one or more O-rings that provide a moisture seal to ensure that no vapor or corrosive substance enters the socket to corrode the pins or connecters.

The UV lamp socket may also be provided with a raised wall that surrounds the UV lamp socket and has an outer diameter that corresponds to an inner diameter of the opening in the base. This wall functions as a light shield such that when a user is withdrawing the removable body from the base, the raised wall will prevent any UV light from laterally escaping prior to the pins in the power cavity disconnecting from the raised power receptacle.

Opposite the raised power receptable is a protrusion extending from the base. The protrusion is designed to be received in a corresponding locking cavity on the removable body. The lateral cavity is provided opposite the power socket cavity. The protrusion may be formed as two tines that are adapted to frictionally interact with the locking cavity providing further stabilization for the removable body.

In still another configuration, the base is provided with a plurality of openings that may be formed in the periphery of the base around the central opening and/or on laterally extending tabs that correspond to openings on the removable body. These openings are provided to mount or secure the base to the ductwork. In one configuration, both the base and the removable body may be secured to the ductwork with screws or bolts. In another configuration only the base is secured to the ductwork with screws or bolts and the removable base is then secured to the base with screws or is only friction-fit secured to the base.

In another configuration, the raised power socket is detachable from the base. For example, the base can be provided with a power socket opening that is designed to receive the raised power socket. The raised power socket may be provided with deformable locking devices that interact with an inner upper edge of the power socket opening such that when the raised power socket is fully inserted into the power socket opening, the locking devices pass beyond the upper inner edge of the power socket opening and prevent the raised power socket from being withdrawn from the power socket opening.

A power cord extends from the raised power socket to a ballast, which in turn has a cord extending therefrom to be connected to a source of AC (e.g., 120V AC). The ballast will convert and regulate the 120V AC to an appropriate voltage and frequency for use with commercial UV lamps used for disinfection.

It should be noted that the pin configuration for the UV lamp could comprise either a 2 or 4 pin configuration as is known in the art.

In still another configuration an over-limit thermostat is provided in the power cord/cable that is coupled to the raised power receptacle.

It is contemplated that the system may be provided with diagnostic capabilities that can provide an alert if the UV lamp fails. For example, if the UV lamp fails and shuts off, the system could provide a visual indication of the failure (e.g., a Red LED that flashes). If the UV lamp is installed and functioning properly, the system could provide a positive indication (e.g., a Green LED). In this way a simple visual indication from the exterior of the ductwork can be done to confirm the device is functioning properly without any need of being exposed to the harmful UV light.

In addition to the visual indication an audio warning could be provided (e.g., a chip) to alert individuals that the UV lamp has failed. Since ductwork is typically located in closed rooms or spaces that see little traffic, it is further contemplated that an automatic warning could be transmitted that the UV lamp has failed or that it should be replaced. For example, with the advent of the Internet of Things (IoT), it is possible to have a message sent as a text or email to for example, a user device via a network connection.

For this application the following terms and definitions shall apply:

The term "data" or "information" as used herein means any indicia, signals, marks, symbols, domains, symbol sets, representations, and any other physical form or forms representing information, whether permanent or temporary, whether visible, audible, acoustic, electric, magnetic, electromagnetic or otherwise manifested. The term "data" as used to represent predetermined information in one physical form shall be deemed to encompass any and all representations of the same predetermined information in a different physical form or forms.

The term "network" as used herein includes both networks and internetworks of all kinds, including the Internet, and is not limited to any particular network or inter-network.

The terms "first", "second" and "third" are used to distinguish one element, set, data, object or thing from another, and are not used to designate relative position or arrangement in time.

The terms "coupled", "coupled to", "coupled with", "connected", "connected to", and "connected with" as used herein each mean a relationship between or among two or more devices, apparatus, files, programs, applications, media, components, networks, systems, subsystems, and/or means, constituting any one or more of (a) a connection, whether direct or through one or more other devices, apparatus, files, programs, applications, media, components, networks, systems, subsystems, or means, (b) a communications relationship, whether direct or through one or more other devices, apparatus, files, programs, applications, media, components, networks, systems, subsystems, or means, and/or (c) a functional relationship in which the operation of any one or more devices, apparatus, files, programs, applications, media, components, networks, systems, subsystems, or means depends, in whole or in part, on the operation of any one or more others thereof.

The term "automatic" and variations thereof, as used herein, refers to any process or operation done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

As used herein, the phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B and C together.

In one configuration, a system for disinfecting the air moving within a ductwork is provided, the system comprises a base that is connectable to an exterior surface of the ductwork, the base including a central opening that is designed to be aligned with an opening formed in the surface of the ductwork and a power connector formed as a raised power socket and coupled to a power cord. The system further comprises a removable body including a UV lamp socket designed to receive a UV lamp and a power socket cavity including a plurality of pins adapted to engage with openings formed in the raised power socket where the UV lamp socket is electrically coupled to the plurality of pins. The system is provided such that the raised power socket includes a seal that is adapted to engage with an inner surface of the power socket cavity to seal the pins from moisture entering the power socket cavity.

In another configuration, a system for disinfecting the air moving within a ductwork is provided, the system comprises a base that is connectable to an exterior surface of the ductwork, the base including a central opening that is designed to be aligned with an opening formed in the surface of the ductwork, a power connector formed as a detachable raised power socket and coupled to a power cord, where the power cord includes an over-limit thermal switch formed in the power cord. The system further comprises a removable body including a UV lamp socket designed to receive a UV lamp and a power socket cavity including a plurality of pins adapted to engage with openings formed in the raised power socket where the UV lamp socket is electrically coupled to the plurality of pins.

Other objects of the invention and its particular features and advantages will become more apparent from consideration of the following drawings.

DETAILED DESCRIPTION OF THE INVENTION

Figure 1:
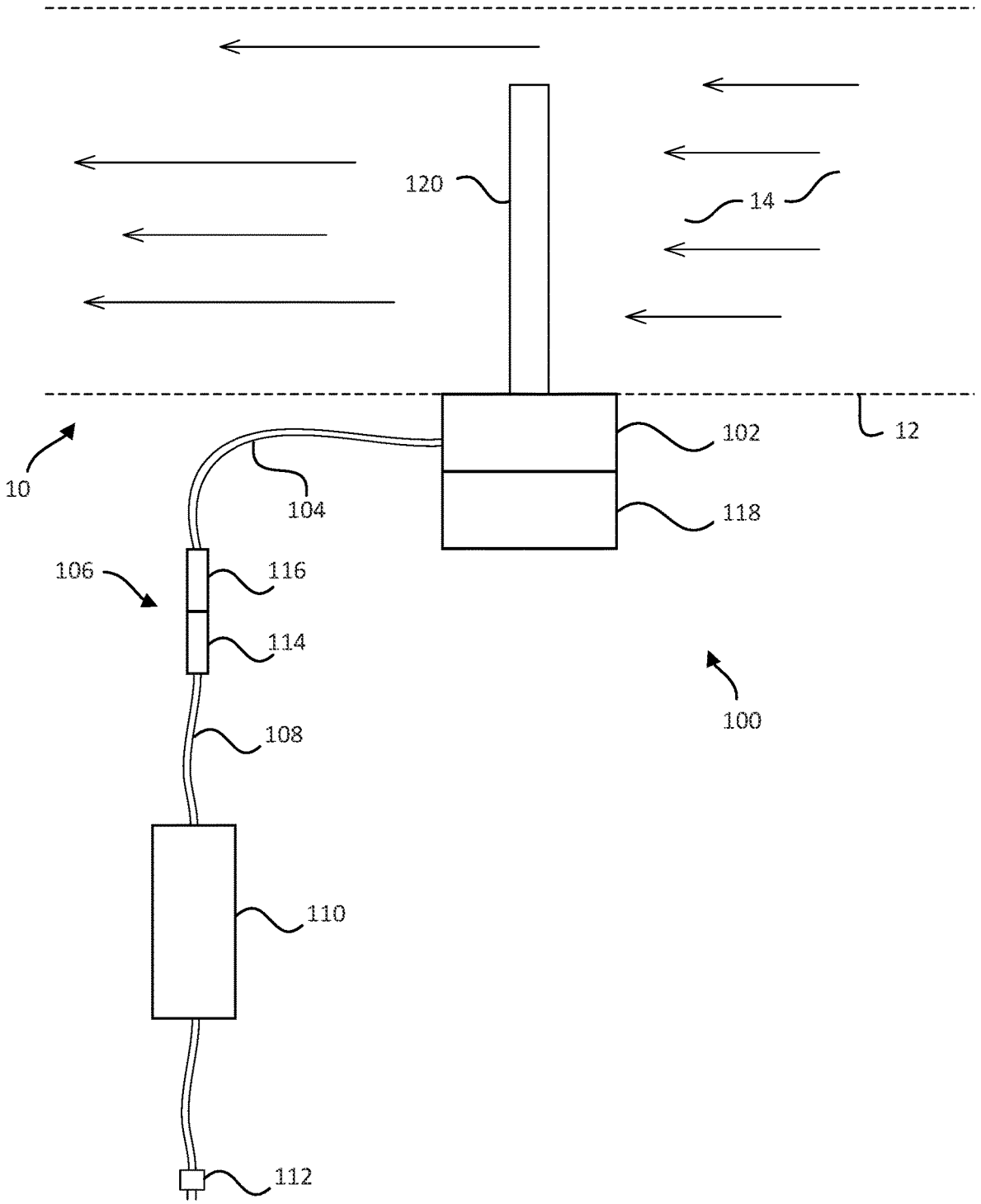
FIG. 1 is a diagram of the UV light system installed in the side of a duct according to one configuration of the invention.

Referring now to the drawings, wherein like reference numerals designate corresponding structure throughout the views.

FIG. 1 is a diagram of the UV light disinfection system 100 installed in an air duct 10. The UV light disinfection system 100 includes a base 102 that is affixed to an exterior surface 12 of the duct. The base 102 includes a power cord 104 that is coupled at a distal end to a thermal switch 106, which in turn is connected via a power cable 108 to a ballast 110. The ballast is then connectable to a power source via a plug-in connector 112. It should be noted that while a plug-in connector 112 is illustrated, those of skill in the art will appreciate that a hard-wired connection could also be used depending on the voltage supplied to the ballast 110 (e.g., 120V, 277V, etc.).

Figure 9:
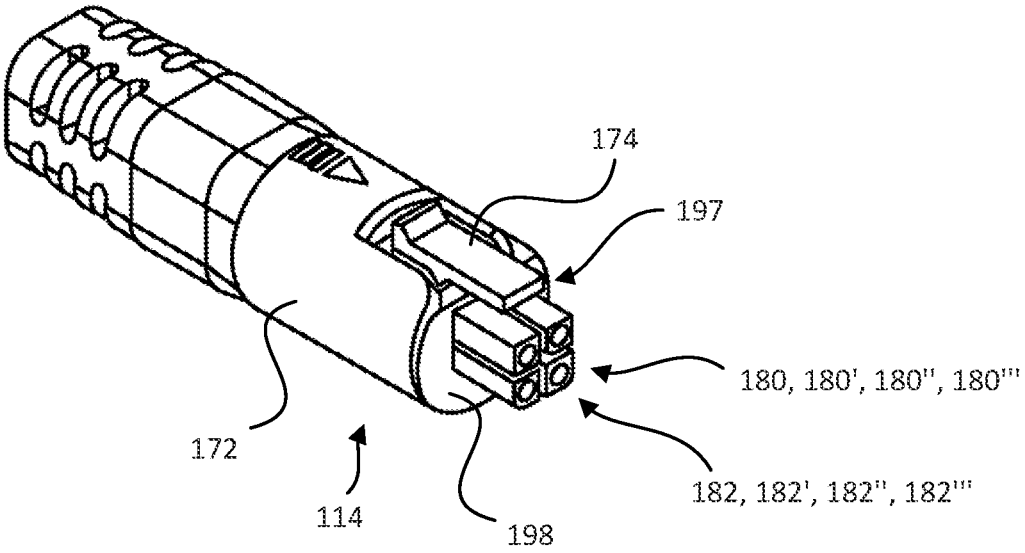
FIG. 9 is the male side of an in-line thermal switch for a power cord that is coupled to a power receptacle that is removably coupled to the base according to FIG. 1.
Figure 10:
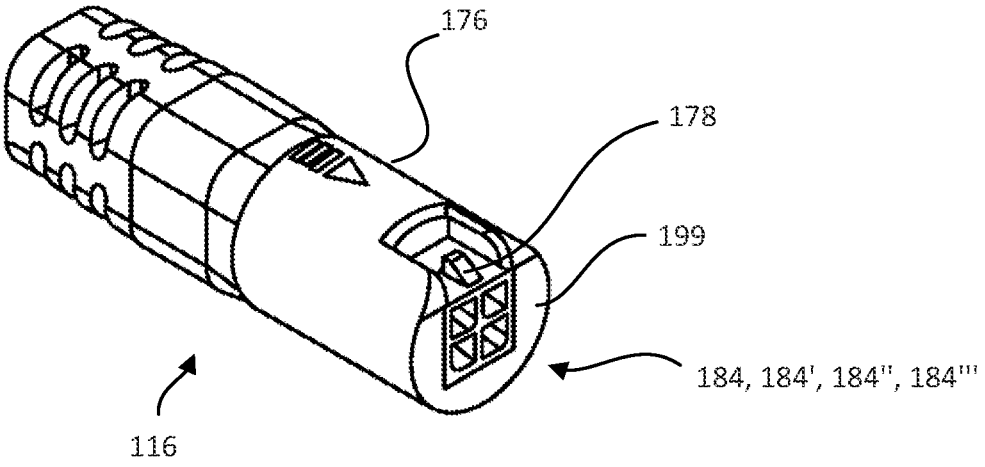
FIG. 10 is the female side of the in-line thermal switch according to FIG. 1.

The thermal switch 106 as illustrated in FIG. 1 is formed as two disconnectable units formed as a male and female connector 114, 116 respectively and are shown in more detail in connection with FIGS. 9 and 10.

Also shown in FIG. 1 is removable body 118 that includes a UV lamp 120. Power is supplied to the base 102, which is fed to the removable body 118 to power the UV lamp 120. The UV lamp 120 is positioned inside of the duct 10 and in the flow of air 14 within the duct 10. The UV light emitted from the UV lamp 120 functions to kill virus and/or bacteria that may be resident in the circulating air.

Figure 2:
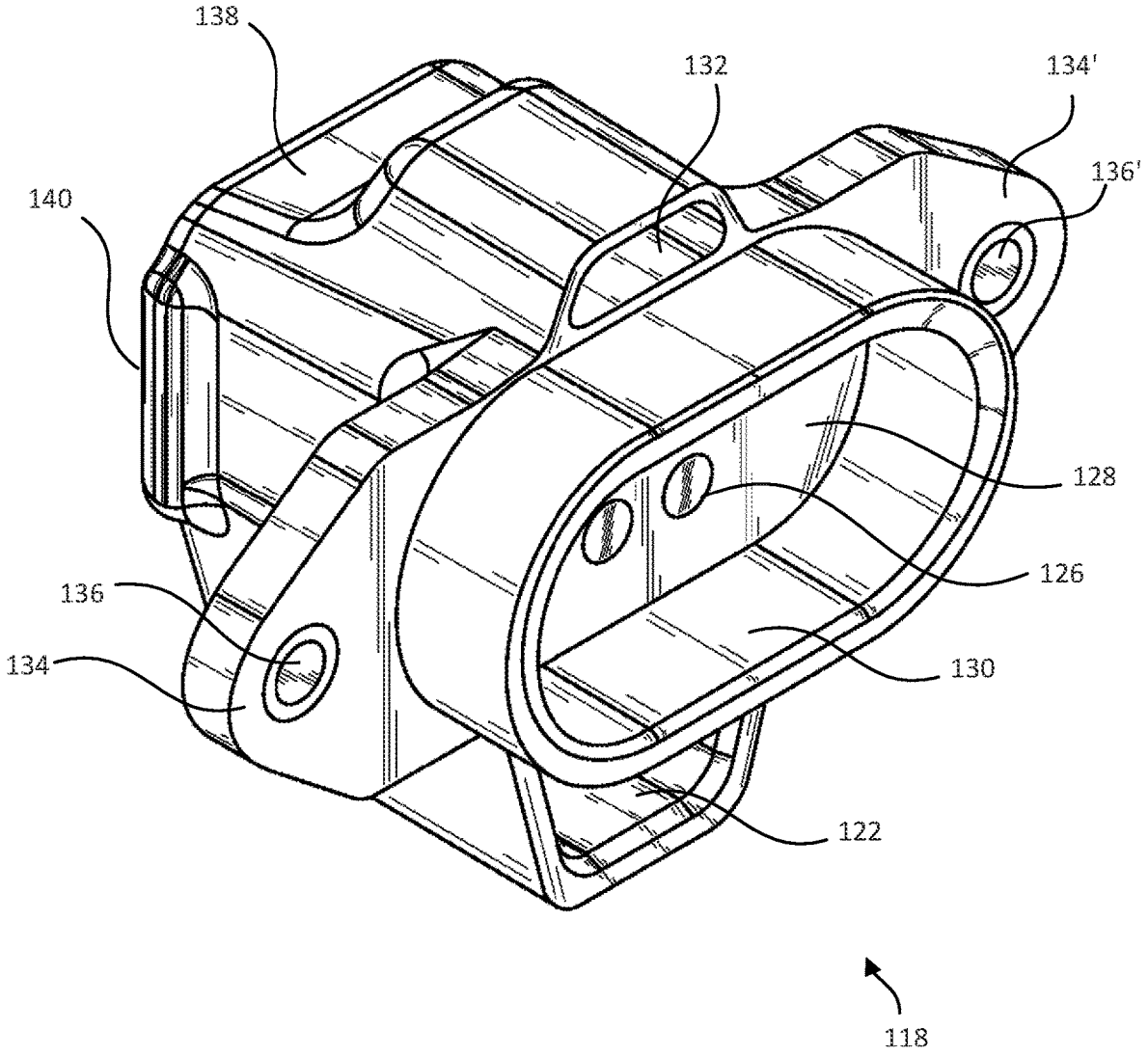
FIG. 2 is an illustration of the removable body according to FIG. 1.
Figure 3:
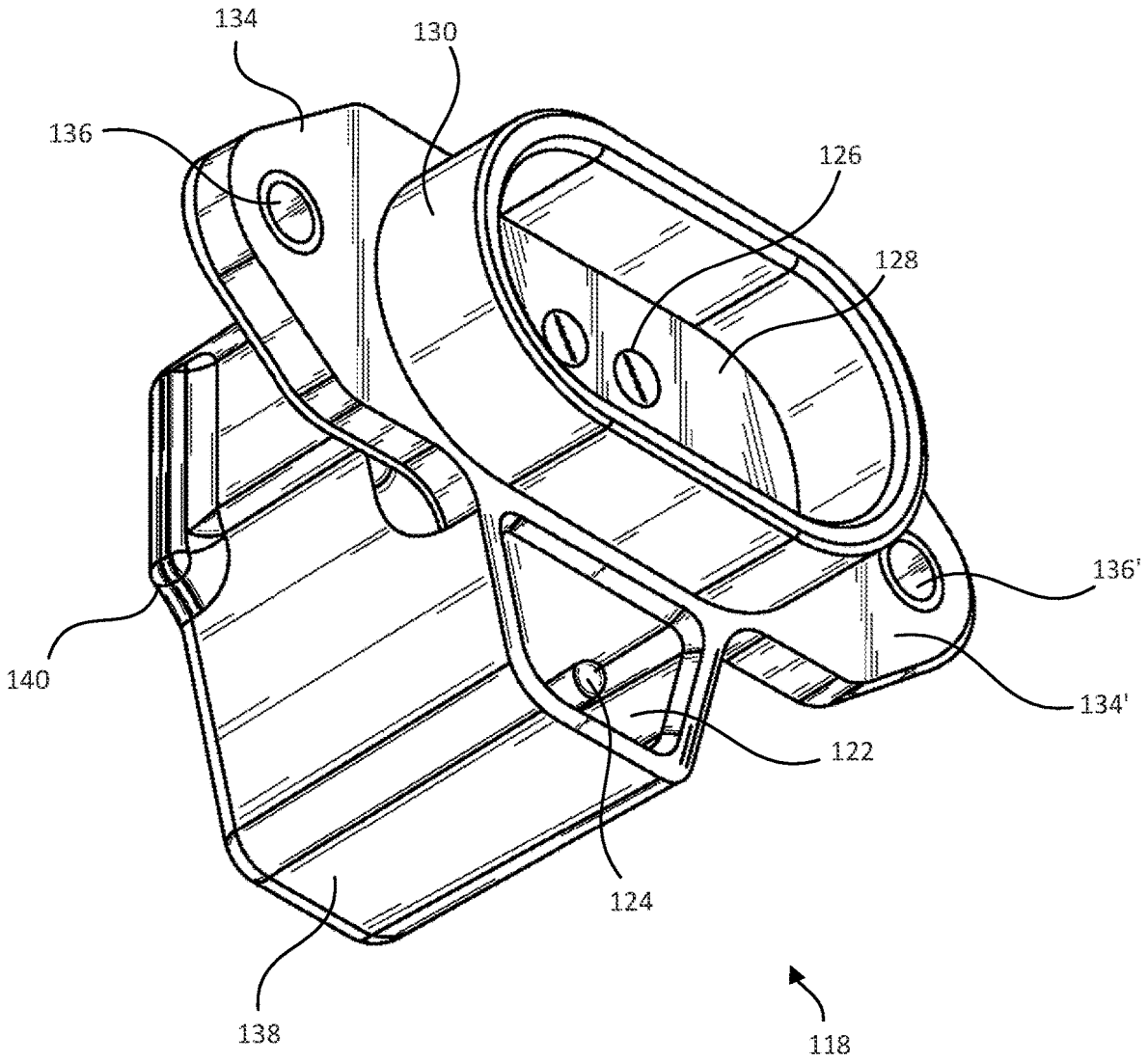
FIG. 3 is an illustration of the removable body according to FIG. 2.
Figure 4:
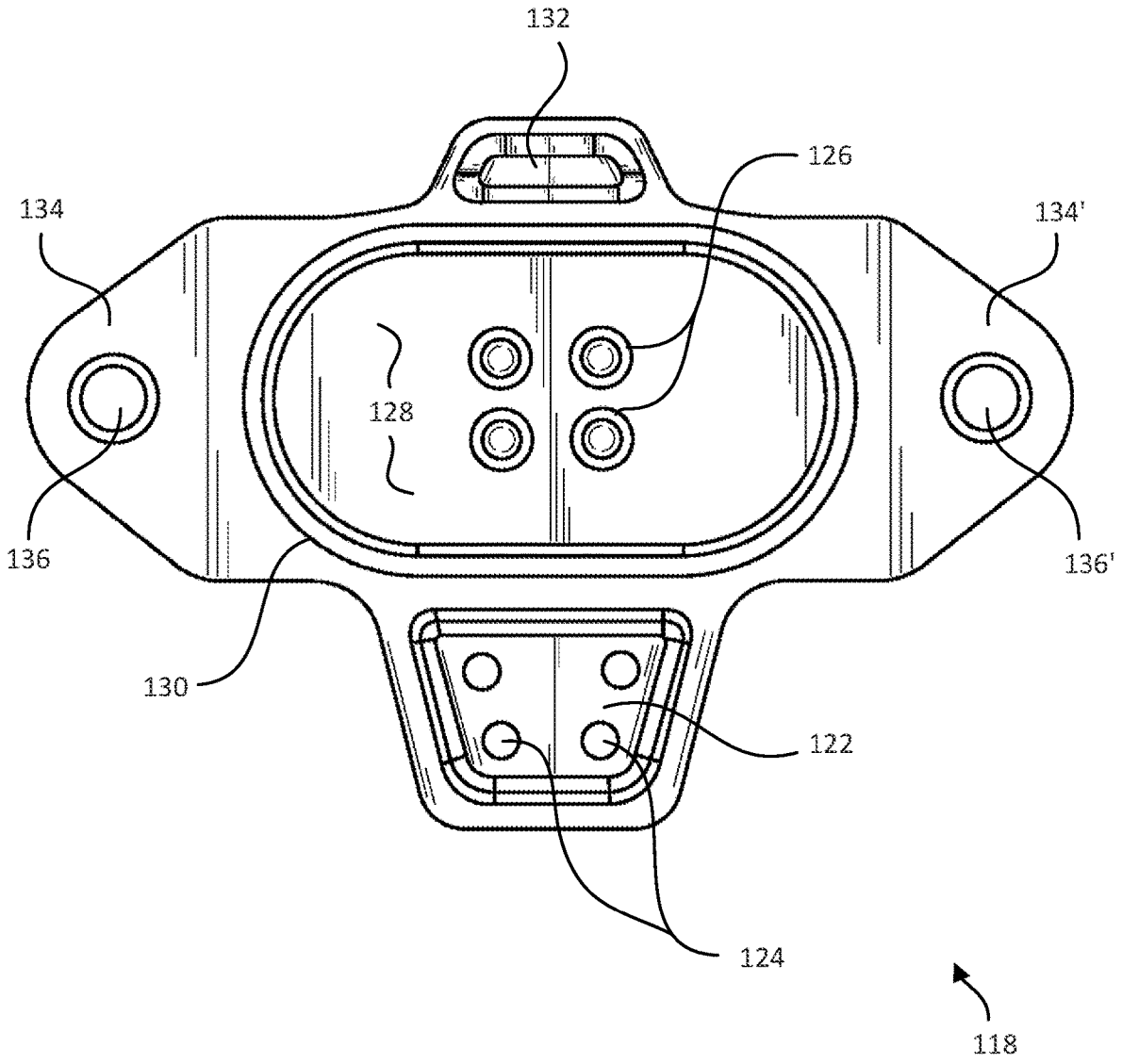
FIG. 4 is an illustration of the removable body according to FIG. 2.

Referring now to FIGS. 2-4, the removable body 118 is shown in greater detail. The removable body 118 is provided with a power socket cavity 122 that include one or more (in this case four) power pins 124 that are designed to engage with a corresponding receptacle on the base 102. The power pins are adapted to transmit electrical power from the power pins 124 to corresponding UV socket receptacle 126 positioned in UV cavity 128. In this configuration, four power pins 124 are provided. However, one of skill in the art will understand that any number of pins may be provided (i.e., 2-pin, 4-pin) and that more than one UV socket receptacle may be provided.

The UV cavity 128 is bounded by a raised wall 130 that extends upward from a face of the UV socket receptacle 126. The raised wall 130 functions as a light shield when the removable body is being withdrawn from or inserted into the base 102. This function will be described in greater detail in connection with FIG. 8.

The removable body 118 further includes a lateral cavity 132 positioned opposite the power socket cavity 122 from the raised wall 130. Lateral cavity 132 is adapted to interact with a protrusion 164 (FIG. 5) positioned on base 102.

Also illustrated are laterally extending tabs 134, 134' which include lateral openings 136, 136' respectively that are adapted to receive a bolt or a screw 170, 170' (FIG. 8) for securing the removable body 118 to the base 102.

An upper portion 138 of the removable body 118 is provided with a gripping surface 140 formed as a raised portion allowing a user to firmly grasp the removable body 118 when detaching it from the base 102.

Figure 5:
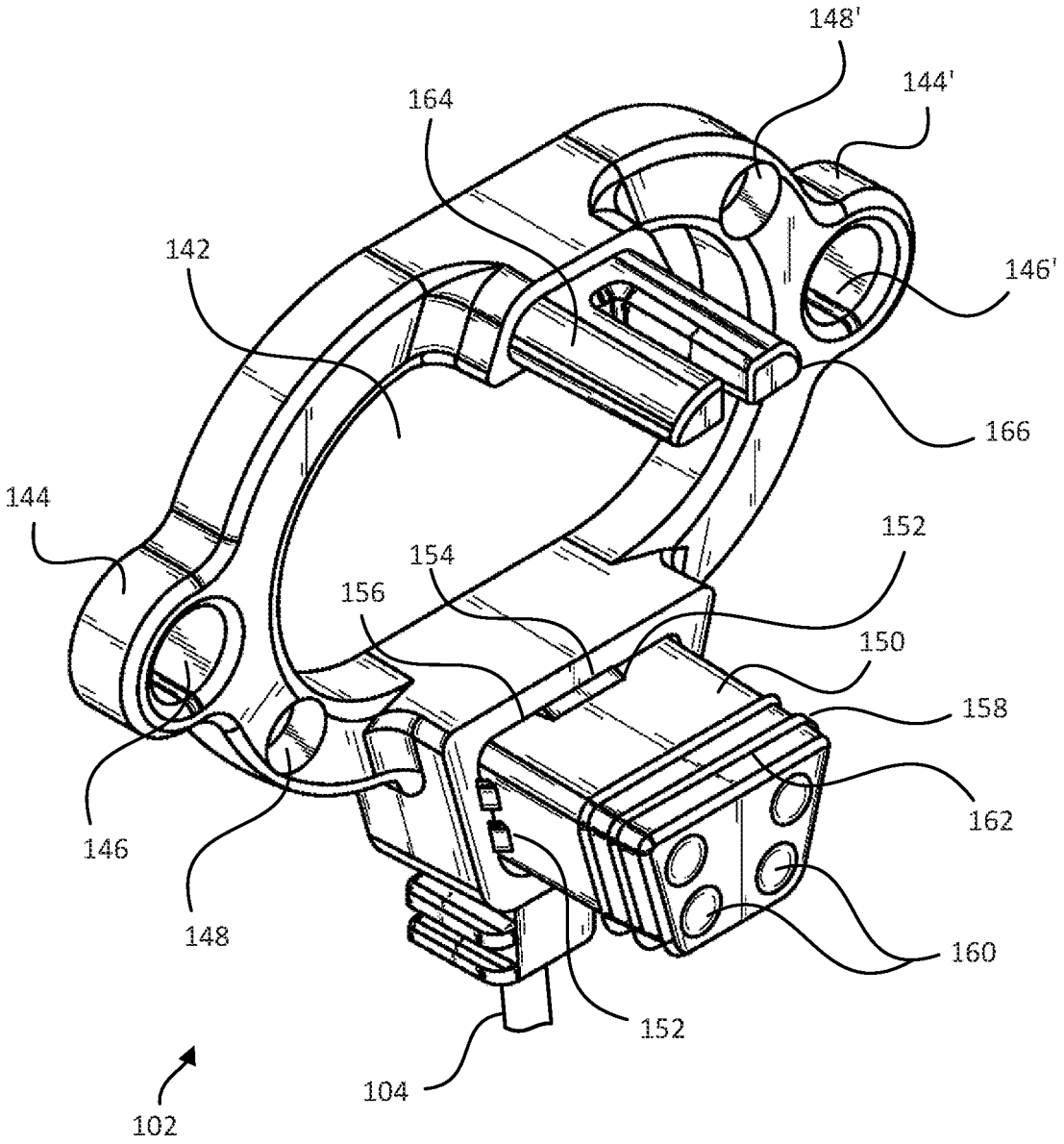
FIG. 5 an illustration of the base according to FIG. 1.
Figure 6:
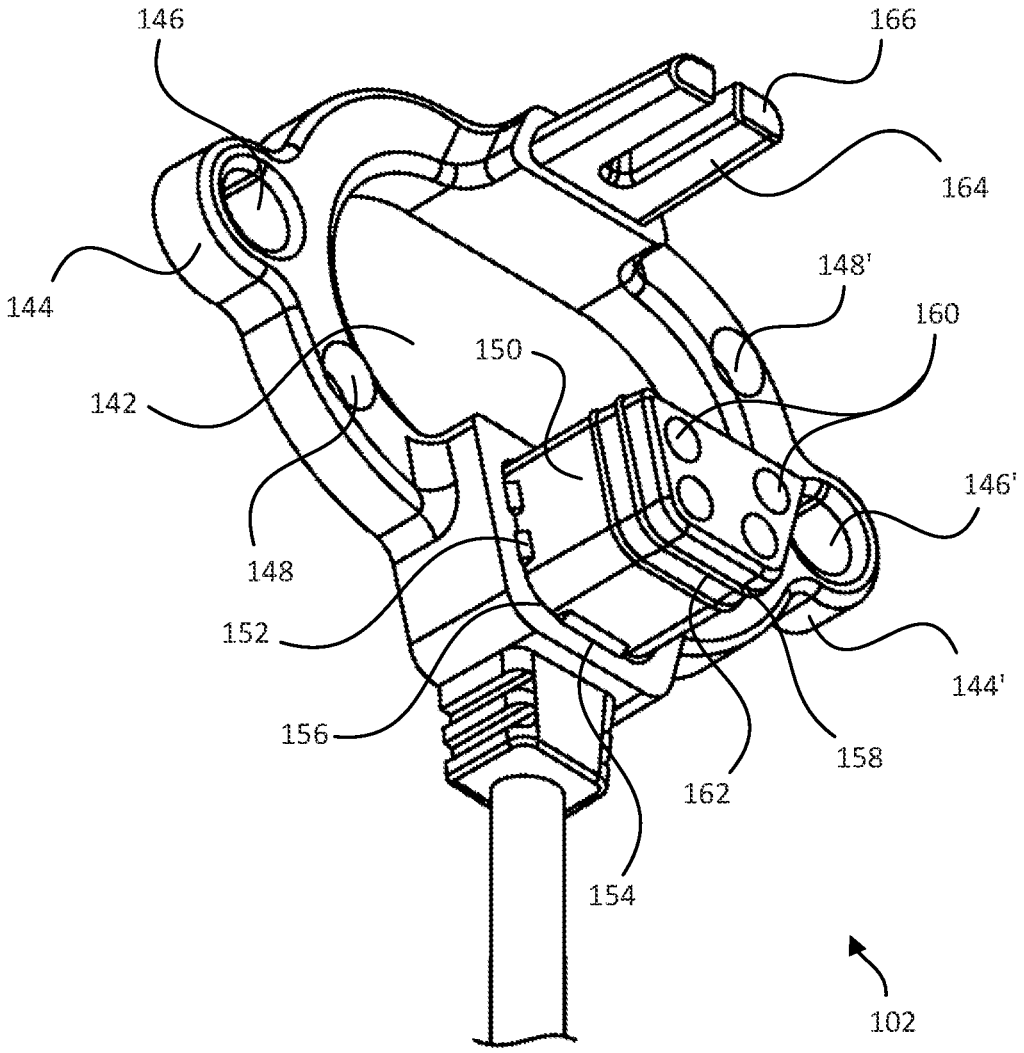
FIG. 6 is an illustration of the base according to FIG. 5.
Figure 7:
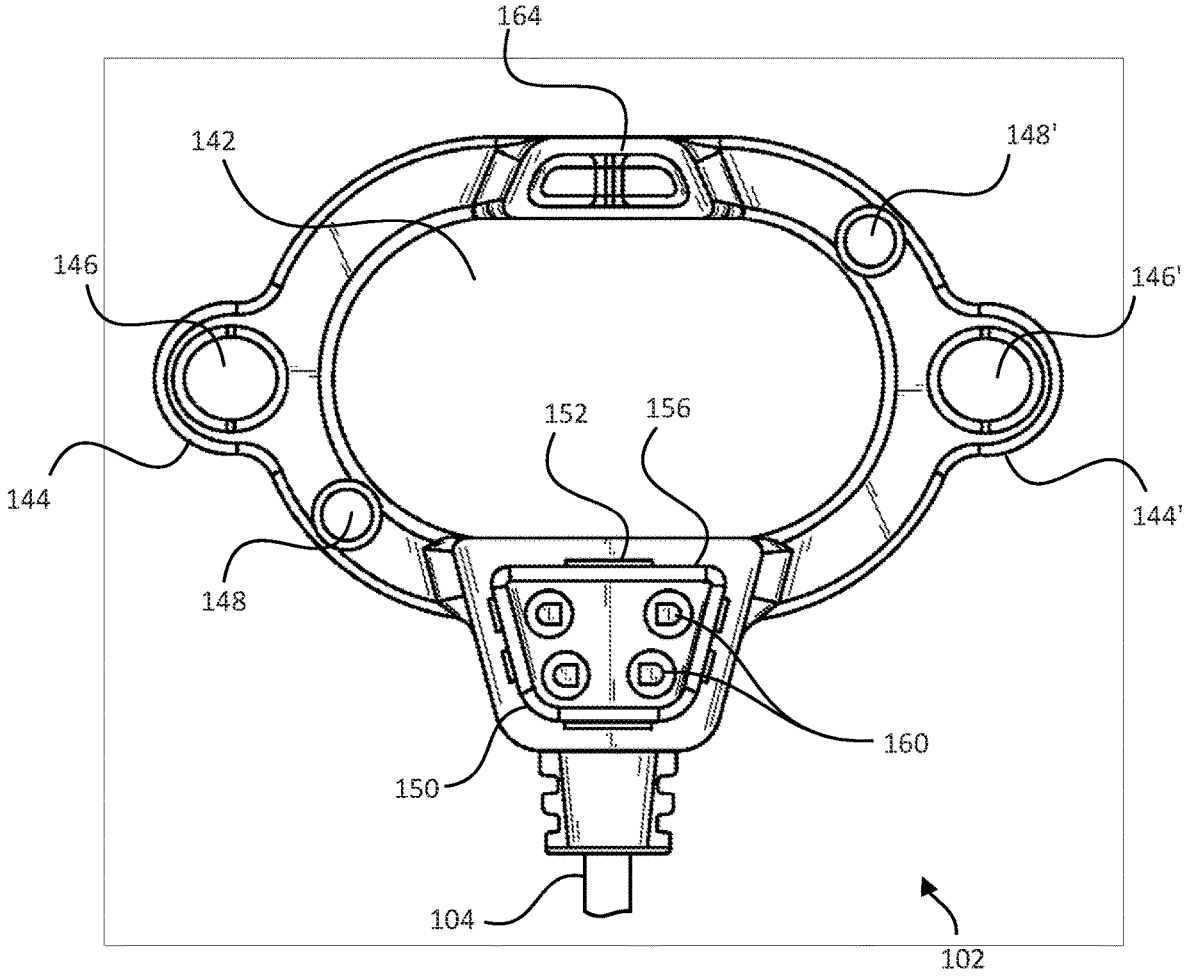
FIG. 7 is an illustration of the base according to FIG. 5.

Turning now to FIGS. 5-7, the base 102 is illustrated from several different angles. In particular, the base 102 is provided with a central opening 142, which is designed to align with a hole that is cut into the side of a duct. The base includes two laterally extending tabs 144, 144' that are generally aligned with the laterally extending tabs 134, 134' on the removable body 118. Lateral openings 146, 146' are provided in laterally extending tabs 144, 144' respectively. In this way, when the removable body 118 is positioned on base 102, it can be secured by screws or bolts 170, 170' (FIG. 8) extending through the lateral openings 136, 136', 146, 146'. Additional openings 148, 148' may also be provided in base 102.

Also shown in base 102 is raised power receptacle 150. Raised power receptacle 150 is provided as a removable power device that is secured in power receptacle opening 190, which is better seen in FIG. 11. The raised power receptacle 150 is provided with at least one tine 152 that is provided with an undercut 154 adapted to interact with an edge 156 of the power receptacle opening 190. To form an interlock between the tine 152 and the edge 156. To remove the raised power receptacle 150, the tine 152 must be pushed inward relative to the edge 156, such that the raised power receptacle 150 can be pushed downward relative to the edge 156 and withdrawn from power receptacle opening 190.

The raised power receptacle 150 is provided with at least one seal 158 positioned on an exterior surface thereof. While two seals 158 are illustrated in FIGS. 5-7, it is contemplated that one or more than two may be provided. The seal 158 is designed in interact with an inner surface of power socket cavity 122 to form a seal preventing moisture from reaching pins 124 and power sockets 160 that are adapted to receive pins 124 respectively. The seal 158 can be formed of any suitable material that can form a moisture seal such as silicon or rubber. The seal 158 will typically sit in a channel 162 that is cut into the surface of the raised power receptacle 150 to securely hold the seal 158 in place.

Also shown in FIGS. 5-7 is a protrusion 164 that is formed as two parallel extending protrusions. The protrusion 164 is formed to match the interior surface of lateral cavity 132. For example, an exterior surface of protrusion 164 is partially formed as a rounded surface where a distal end 166 of protrusion 164 may be provided with beveled edge. It is contemplated that the protrusion will friction fit within lateral cavity 132.

Figure 8:
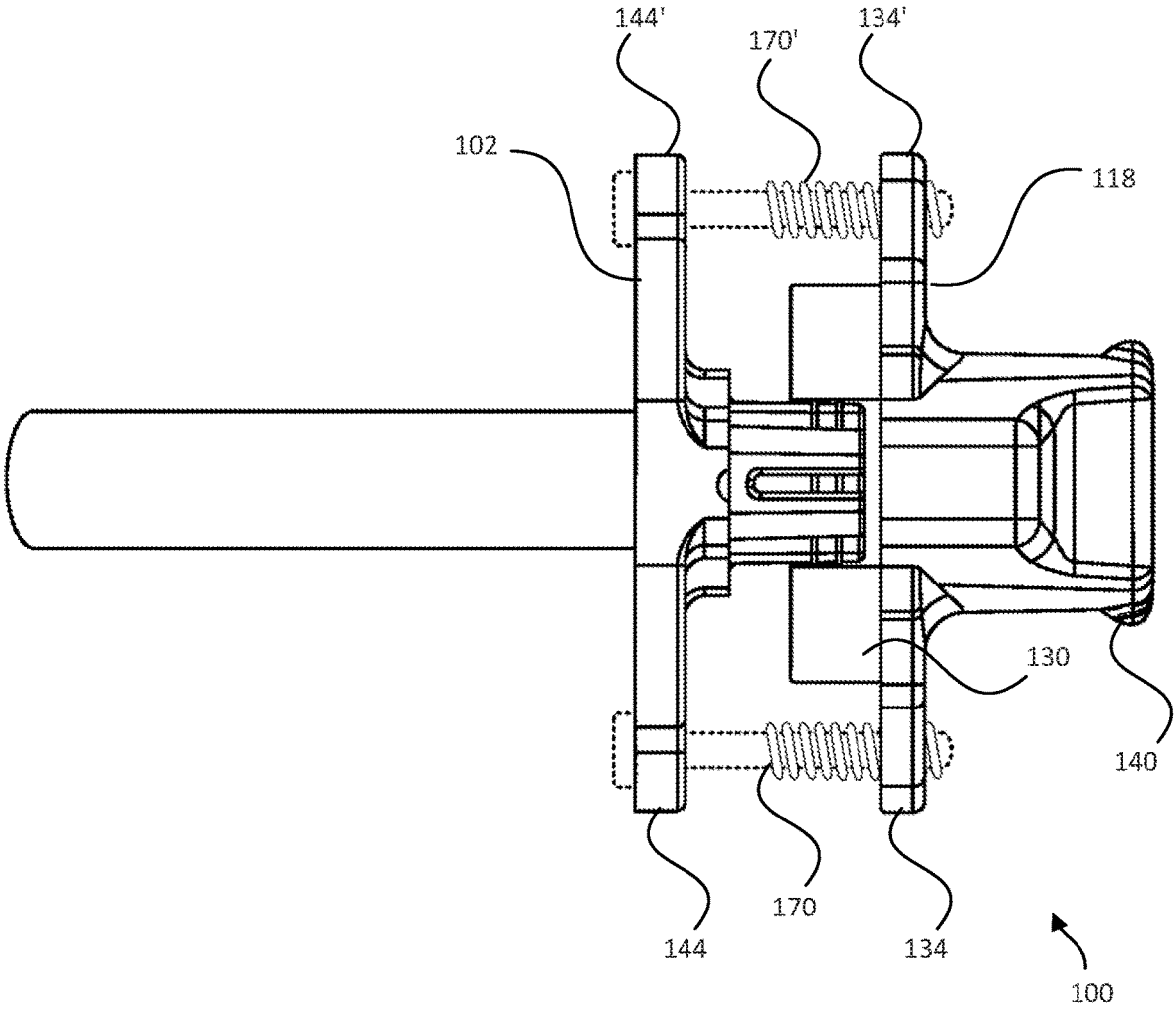
FIG. 8 is an illustration of the removable body being inserted into the base according to FIG. 1.

FIG. 8 provides an exploded view of the base 102 and removable body 118. As can be seen, bolts or screws 170, 170' may be used to secure the removable body 118 to base 102. It is contemplated that these may be secured through the duct 12 or the base 102 may be independently secured to the duct 12 and the removable body 118 is then secured to base 102.

In operation, the UV lamp that is attached to removable body 118 will not be turned on until the power pins 124 make electrical contact with power sockets 160. The device is designed such that the power pins 124 not make electrical contact with power sockets 160 until the removable body 118 is seated well down onto base 102. This allows the upstanding wall 130 to enter the central opening 142 prior to the UV lamp 120 turning on thereby forming a light shield to prevent UV light from impinging on any worker installing or maintaining the system 100.

Additionally, the power pins 124 are inserted in each of their respective power sockets 160 some distance prior to electrical contact being made. This ensure that no arching can occur between pins to or to any other part of the device. A major problem that has been noted with duct-mounted UV light disinfectant systems is that moisture can build up in the light and especially around the power coupling. This moisture functions to corrode the pins and lowers the resistance for arching within the light fixture. The carbon scoring and subsequent damage to the UV light fixture require complete removal and replacement of the light fixture well before the lifespan of the device has been reached. However, the unique design of the UV light disinfectant system 100 addresses many of these problems by providing the raised power receptable 150 that interacts with power cavity 122. Additionally, the seals 158 on the surface of the raised power receptable 150 interacts with the inner surface of the power cavity 122 to prevent moisture from reaching the power pins 124 and the respective power sockets 160. Finally, the configuration of the power sockets 160 not allowing connection to the power pins 124 until the power pins 124 are almost fully inserted also prevents arching and ensures power is not turned on to the UV lamp until the upstanding wall enters central opening 142. All these features greatly enhance the safety and reliability of the UV light disinfectant system 100.

FIGS. 9 and 10 show the male connector 114 and female connector 116 that form thermal switch 106 that is formed in-line with power cord 104 and power cable 108 respectively. Male connector 114 includes a body 172 that includes a locking mechanism 174 in the form of a laterally displaceable arm. The female connector also includes a body 176 having a protrusion 178 that is adapted to interact with locking mechanism 174 when the two are axially aligned and inserted.

The male connector is formed have four pins 180, 180', 180", 180''' that may be formed in four axially extending structures 182, 182', 182", 182''', which in this case are formed as rectangular structures. The axially extending structures 182, 182', 182', 182''' are integrally formed as part of the body 172 providing lateral strength and protection to the pins 180, 180', 180", 180''' to avoid damage. The end 197 of the body 172 may be provided with a seal 198 that overlays the end 197.

The female connector 116 is provided with four receptacles 184, 184', 184", 184''' that are designed to receive the axially extending structures 182, 182', 182", 182''' and allow for the pins 180, 180', 180", 180" to form an electrical connection to the four wires extending through the power cord 106 to raised power receptacle 150.

When the end 199 abuts end 197, the seal 198 forms a moisture tight seal therebetween preventing any moisture from getting into the pins 180, 180', 180", 180''' causing corrosion or arching. It is contemplated that the seal may comprise any type of material that is pliable a liquid resistant as is known in the art. Additionally, the seal 198 not only surrounds the perimeter of end 197, but in one embodiment covers the entire face of end 198 including the areas of the face 197 in between the axially extending structures 182, 182', 182", 182'''. In this manner, not only are the pins 180, 180', 180", 180''' sealed from the outside, but are sealed from each other.

Figure 11:
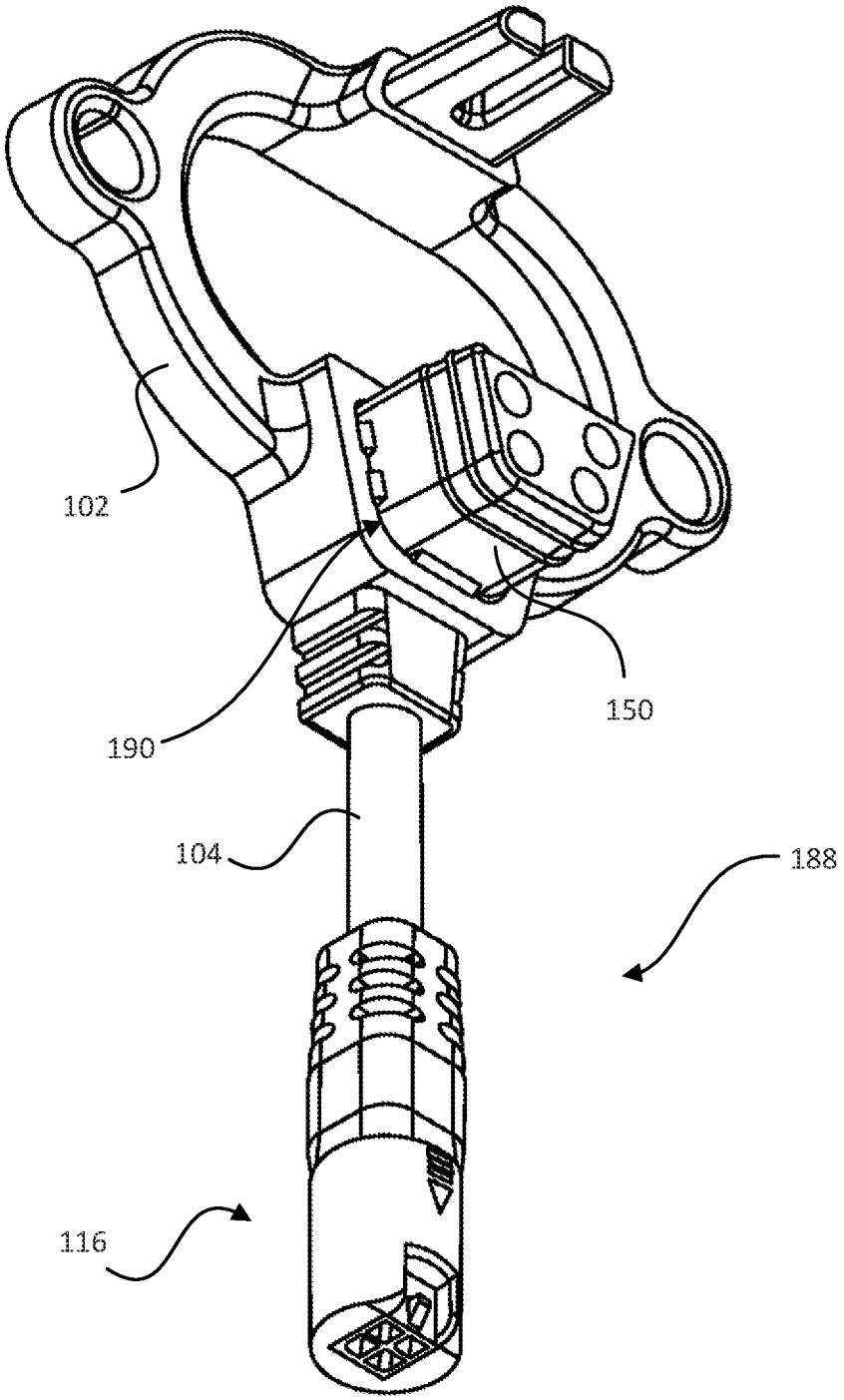
FIG. 11 is an illustration of the base with a dongle according to FIG. 1.
Figure 12:
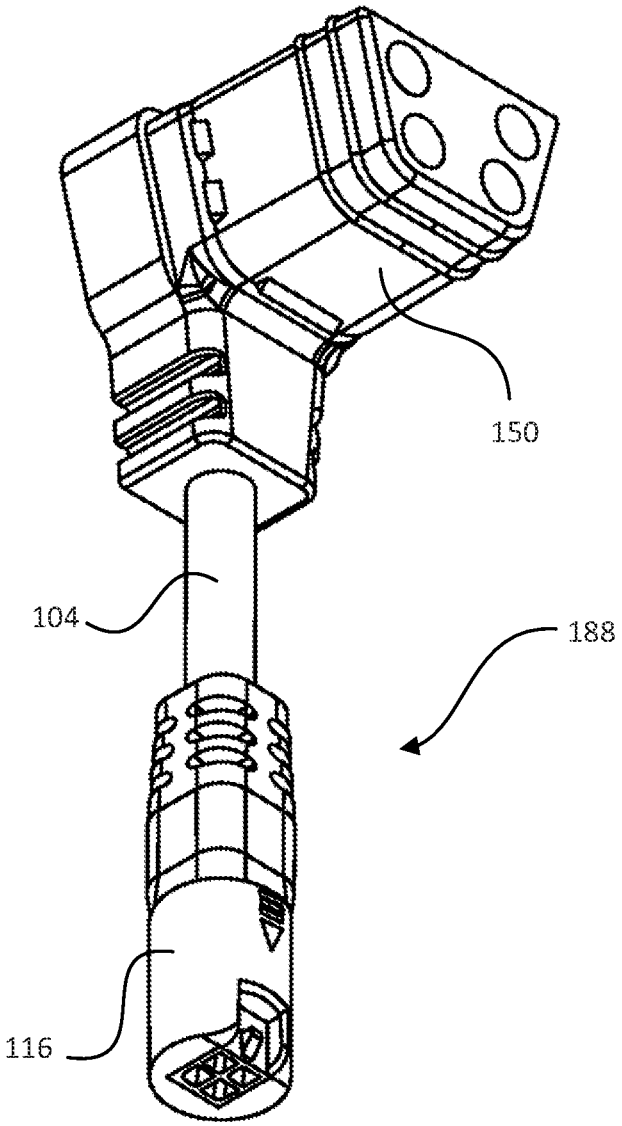
FIG. 12 is an illustration of the power receptacle and dongle according to FIG. 11.

FIGS. 11-12 illustrate the removable nature of the raised power receptacle 150 from the base 102. For example, as can be seen in FIG. 11, the raised power receptacle, the power cord 104 and the female connector 116 (collectively, a detachable power dongle 188) is shown fully inserted into base 102. FIG. 12 shows the detachable power dongle 188 completely detached from base 102. To attach the detachable power dongle 188 to base 102, the raised power receptacle is simply inserted into power receptacle opening 190. As tine 152 enters power receptacle opening 190 as raised power receptacle 150 is advanced, this will function to laterally displace tine 152 inward. Once tine 152 passes edge 156 it will snap outward again forming an interlock preventing the raised power receptacle from being removed from power receptacle opening 190. It is contemplated that while a mechanical interlock is illustrated, different types of interlocks could be provided including, for example, a friction fit, or a groove and channel configuration and the like.

Figure 13:
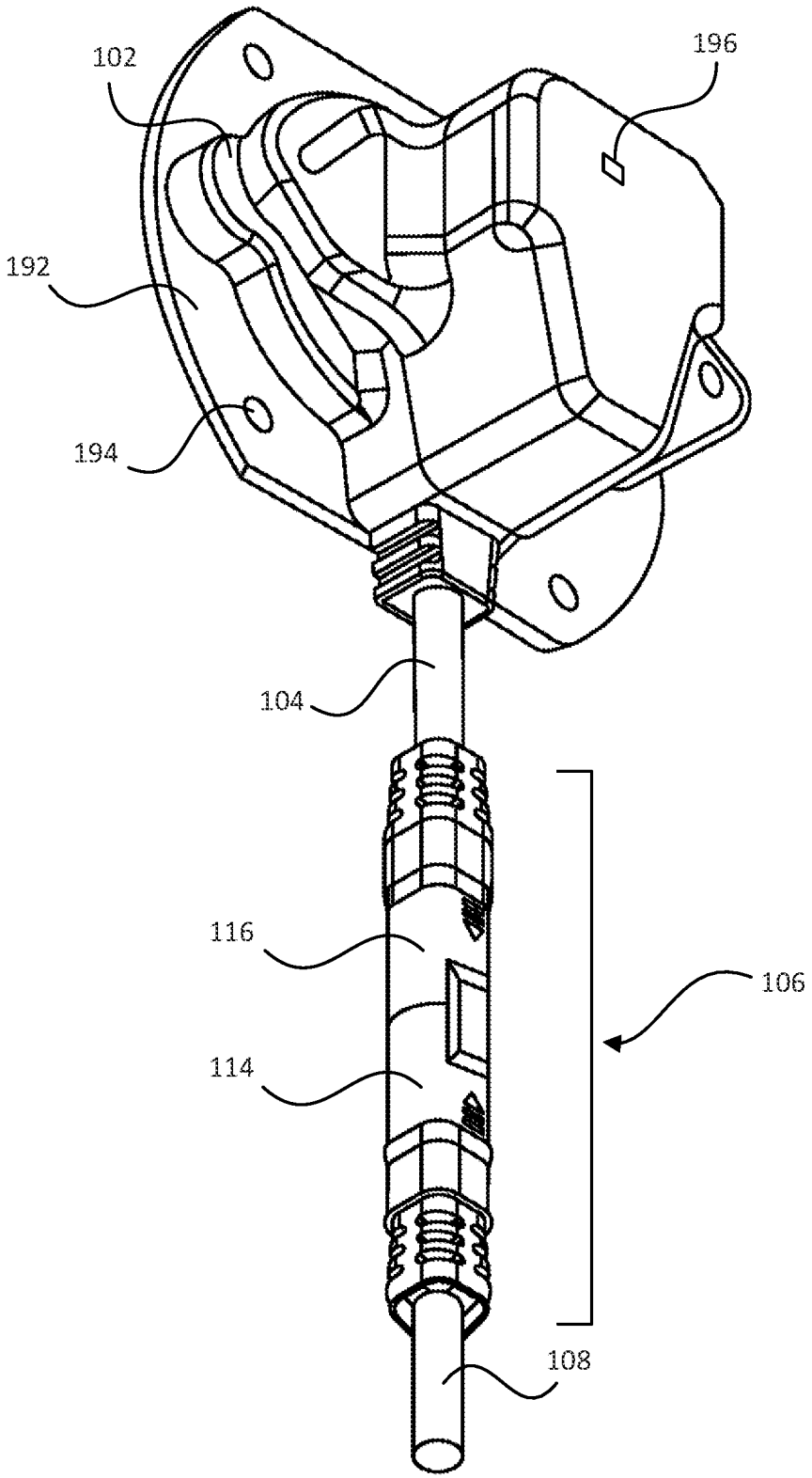
FIG. 13 is an illustration of the UV light system assembled according to FIG. 1.

FIG. 13 is a view of the removable body 188 affixed to the base 102, which is in turn affixed to a mounting plate 192 that may be affixed to the outer surface of the duct 12. The mounting plate may be affixed to the duct via screws or bolt via holes 194. The mounting plate may comprise metal or any other appropriate material. Also shown are the male and female connectors 114, 116 attached to power cable 108 and power cord 106 respectively.

Also shown in FIG. 13 is an indicator 196 that may be positioned on or in removable body 118. In one configuration, the indicator 196 may be provided as one or more LEDs that provide a visual status indication of the UV lamp 120.

It is contemplated that the UV light disinfectant system 100 may be provided with the ability to run self-diagnostics to determine the status of the UV lamp 120. In one configuration, if the UV lamp burns out or does not turn on (i.e., the ballast 110 is not functioning properly), the UV light disinfectant system 100 could provide an indication of the failure. In one configuration, the indictor 196 could provide a flashing red LED as opposed to showing a solid green LED when functioning properly. This is a simple and easy way to provide UV lamp 120 function information for maintenance personnel that are performing an inspection of the device.

It is further contemplated that the indicator 196 may provide an audio indication to alert maintenance personnel of a UV lamp 120 failure. The audio indication could be provided as a chip as is common with, for example, smoke detectors.

As ducts are often located in closed rooms or spaces that see little traffic, it may further be advantageous to provide a remote indication. For example, if the UV lamp disinfectant system 100 determines that the UV lamp 120 is out or the system is malfunctioning, an automatic warming could be transmitted via a network connection to a remote computer. This automatic warning could be transmitted wirelessly to a building automation system computer providing information relating to the location of the device in the facility. The building automation system could then automatically transmit information relating to the warning to a mobile device carried by maintenance personnel in the form of a text message or email, or even automatically generate a work order to service the device. Alternatively, it could be that the UV lamp disinfection system 100 has measured the total operating hours of the UV lamp 120 and sends an indication that the UV lamp is nearing the end of its life and thus, should be replaced. All of these are possible integration of the device via IoT to provide automated indication, whether to a remote computer in a facility, or even a message sent to a users mobile phone for installations in private homes.

Although the invention has been described with reference to a particular arrangement of parts, features and the like, these are not intended to exhaust all possible arrangements or features, and indeed many other modifications and variations will be ascertainable to those of skill in the art.

What is claimed is:

1. A system for disinfecting the air moving within a ductwork, the system comprising:

a base that is connectable to an exterior surface of the ductwork, said base including:

a central opening that is designed to be aligned with an opening formed in the surface of the ductwork;

a power connector formed as a raised power socket positioned adjacent to the central opening and coupled to a power cord, the raised power socket including a plurality of power socket cavities positioned on an upper surface thereof;

a removable body including;

a UV lamp socket designed to receive a UV lamp;

a power socket cavity including a plurality of pins adapted to engage with the power socket cavities respectively formed in the raised power socket;

said UV lamp socket electrically coupled to the plurality of pins;

a raised wall circumferentially enclosing said UV lamp socket forming a lamp socket cavity such that when the raised power socket is fully inserted into said power socket cavity said raised wall extends into said central opening;

said raised power socket including a seal that is adapted to engage with an inner surface of the power socket cavity to seal the pins and the power socket cavities from moisture entering said power socket cavity;

wherein the power socket cavity is separate and apart from the lamp socket cavity.

2. The system according to claim 1, wherein said seal is formed as an O-ring that surrounds an exterior surface of the raised power socket.

3. The system according to claim 1, wherein the raised power socket is detachable from said base.

4. The system according to claim 3, wherein an exterior surface of the raised power socket includes an undercut that interacts with an edge formed on a power socket opening on said base, such that when the raised power socket is fully inserted into said power socket opening an interlock between the undercut and the edge is formed.

5. The system according to claim 1, wherein when the removeable body is withdrawn from the base, the plurality of pins disconnect from electrical power in the raised power socket prior to said raised wall being fully withdrawn from said central opening, which functions to prevent any UV light from escaping the ductwork prior to power being shut off to the UV lamp.

6. The system according to claim 1, further comprising a protrusion positioned on said base adjacent to said central opening and opposite to said raised power socket.

7. The system according to claim 6, further comprising a lateral cavity positioned on said removeable body and opposite said protrusion such that when the removeable body is attached to said base, said protrusion engages with said lateral cavity.

8. The system according to claim 7, wherein said protrusion is formed as two parallel extending protrusions that are adapted to deflect inward relative to each other to form a friction fit when fully inserted into the lateral cavity.

9. The system according to claim 8, wherein at least one of the two protrusions is provided with a beveled edge or with a rounded surface.

10. The system according to claim 1, wherein said base further comprises a plurality of openings formed on a periphery of the base designed to receive a screw or a bolt for affixing the said base to the ductwork.

11. The system according to claim 10, further comprising at least two laterally extending tabs, wherein each tab has an opening formed therein.

12. The system according to claim 11, further comprising at least two laterally extending tabs on said removeable body each having an opening, wherein the at least two laterally extending tabs on said removeable body correspond to the at least two laterally extending tabs on said base.

13. The system according to claim 1, wherein said power cord extends from said raised power socket to a ballast and said ballast is connected to a source of power.

14. The system according to claim 1, where said power cord further comprises an over-limit thermostat formed in said power cord.

15. The system according to claim 14, where said over-limit thermostat is formed as a male and female connector with a seal positioned therebetween.

16. The system according to claim 1, wherein an indicator is provided on either said base or said removeable body, the indicator providing an indication of a status of the UV lamp.

17. The system according to claim 16, wherein said indictor is selected from the group consisting of: a visual indication, an audio indication, a remote indication and combinations thereof.

18. The system according to claim 17, wherein the remote indication may comprise an email, a text message, electronic alert and combinations thereof, transmitted to a remote device.

* * * * *